US009464515B2

(12) United States Patent
Parsche

(10) Patent No.: US 9,464,515 B2
(45) Date of Patent: Oct. 11, 2016

(54) HYDROCARBON RESOURCE HEATING SYSTEM INCLUDING RF ANTENNAS DRIVEN AT DIFFERENT PHASES AND RELATED METHODS

(71) Applicant: HARRIS CORPORATION, Melbourne, FL (US)

(72) Inventor: Francis Eugene Parsche, Palm Bay, FL (US)

(73) Assignee: HARRIS CORPORATION, Melbourne, FL (US)

( * ) Notice: Subject to any disclaimer, the term of this patent is extended or adjusted under 35 U.S.C. 154(b) by 588 days.

(21) Appl. No.: 13/939,605

(22) Filed: Jul. 11, 2013

(65) Prior Publication Data

US 2015/0013967 A1 Jan. 15, 2015

(51) Int. Cl.
*E21B 43/30* (2006.01)
*E21B 43/24* (2006.01)

(52) U.S. Cl.
CPC ..... *E21B 43/30* (2013.01); *E21B 43/2401* (2013.01)

(58) Field of Classification Search
CPC ..... E21B 43/2401; E21B 43/30
See application file for complete search history.

(56) References Cited

U.S. PATENT DOCUMENTS

| | | | | |
|---|---|---|---|---|
| 4,008,761 | A | 2/1977 | Fisher et al. | |
| 4,449,585 | A * | 5/1984 | Bridges | E21B 36/04 166/245 |
| 6,189,611 | B1 * | 2/2001 | Kasevich | E21B 36/04 166/248 |
| 7,441,597 | B2 | 10/2008 | Kasevich | |
| 2010/0065265 | A1 | 3/2010 | Kasevich | |
| 2010/0078163 | A1 | 4/2010 | Banerjee et al. | |
| 2010/0294488 | A1 | 11/2010 | Wheeler et al. | |
| 2010/0294489 | A1 | 11/2010 | Dreher, Jr. et al. | |
| 2012/0125609 | A1 * | 5/2012 | Parsche | E21B 43/2401 166/272.1 |
| 2013/0062064 | A1 * | 3/2013 | Diehl | E21B 36/001 166/302 |

* cited by examiner

*Primary Examiner* — David Andrews
*Assistant Examiner* — Kristyn Hall
(74) *Attorney, Agent, or Firm* — Allen, Dyer, Doppelt, Milbrath & Gilchrist, P.A.

(57) ABSTRACT

A system for heating hydrocarbon resources in a subterranean formation having spaced-apart wellbores therein aligned in a plane may include radio frequency (RF) antennas to be positioned within respective ones of the spaced apart wellbores aligned in the plane. The system may also include a plurality of discrete RF sources each coupled to one of the RF antennas and configured so that the RF antennas are driven at a same frequency as each other RF antenna but at different phases.

16 Claims, 5 Drawing Sheets

HYDROCARBON RESOURCE HEATING SYSTEM INCLUDING RF ANTENNAS DRIVEN AT DIFFERENT PHASES AND RELATED METHODS

FIELD OF THE INVENTION

The present invention relates to the field of hydrocarbon resource recovery, and, more particularly, to hydrocarbon resource recovery using RF heating.

BACKGROUND OF THE INVENTION

Energy consumption worldwide is generally increasing, and conventional hydrocarbon resources are being consumed. In an attempt to meet demand, the exploitation of unconventional resources may be desired. For example, highly viscous hydrocarbon resources, such as heavy oils, may be trapped in tar sands where their viscous nature does not permit conventional oil well production. Estimates are that trillions of barrels of oil reserves may be found in such tar sand formations.

In some instances these tar sand deposits are currently extracted via open-pit mining. Another approach for in situ extraction for deeper deposits is known as Steam-Assisted Gravity Drainage (SAGD). The heavy oil is immobile at reservoir temperatures and therefore the oil is typically heated to reduce its viscosity and mobilize the oil flow. In SAGD, pairs of injector and producer wells are formed to be laterally extending in the ground. Each pair of injector/producer wells includes a lower producer well and an upper injector well. The injector/production wells are typically located in the pay zone of the subterranean formation between an underburden layer and an overburden layer.

The upper injector well is used to typically inject steam, and the lower producer well collects the heated crude oil or bitumen that flows out of the formation, along with any water from the condensation of injected steam. The injected steam forms a steam chamber that expands vertically and horizontally in the formation. The heat from the steam reduces the viscosity of the heavy crude oil or bitumen which allows it to flow down into the lower producer well where it is collected and recovered. The steam and gases rise due to their lower density so that steam is not produced at the lower producer well and steam trap control is used to the same affect. Gases, such as methane, carbon dioxide, and hydrogen sulfide, for example, may tend to rise in the steam chamber and fill the void space left by the oil defining an insulating layer above the steam. Oil and water flow is by gravity driven drainage, into the lower producer well.

Operating the injection and production wells at approximately reservoir pressure may address the instability problems that adversely affect high-pressure steam processes. SAGD may produce a smooth, even production that can be as high as 70% to 80% of the original oil in place (OOIP) in suitable reservoirs. The SAGD process may be relatively sensitive to shale streaks and other vertical barriers since, as the rock is heated, differential thermal expansion causes fractures in it, allowing steam and fluids to flow through. SAGD may be twice as efficient as the older cyclic steam stimulation (CSS) process. Controlling the location of the SAGD heating may be increasingly difficult as steam has a tendency to rise. Caprock is typically required to contain the steam. In particular, many payzones in the Saskatcheawon Province, Canada lack the necessary caprock for SAGD. Slow conduction heating is may be required initially to soften the formation, so that the convective flow of steam can be initiated. SAGD startup is generally unreliable so many producers experience high failure rates with startup.

Many countries in the world have large deposits of oil sands, including the United States, Russia, and various countries in the Middle East. Oil sands may represent as much as two-thirds of the world's total petroleum resource, with at least 1.7 trillion barrels in the Canadian Athabasca Oil Sands, for example. At the present time, only Canada has a large-scale commercial oil sands industry, though a small amount of oil from oil sands is also produced in Venezuela. Because of increasing oil sands production, Canada has become the largest single supplier of oil and products to the United States. Oil sands now are the source of almost half of Canada's oil production, although due to the 2008 economic downturn work on new projects has been deferred, while Venezuelan production has been declining in recent years. Oil is not yet produced from oil sands on a significant level in other countries.

U.S. Published Patent Application No. 2010/0078163 to Banerjee et al. discloses a hydrocarbon recovery process whereby three wells are provided, namely an uppermost well used to inject water, a middle well used to introduce microwaves into the reservoir, and a lowermost well for production. A microwave generator generates microwaves which are directed into a zone above the middle well through a series of waveguides. The frequency of the microwaves is at a frequency substantially equivalent to the resonant frequency of the water so that the water is heated.

Along these lines, U.S. Published Application No. 2010/0294489 to Dreher, Jr. et al. discloses using microwaves to provide heating. An activator is injected below the surface and is heated by the microwaves, and the activator then heats the heavy oil in the production well. U.S. Published Application No. 2010/0294488 to Wheeler et al. discloses a similar approach.

U.S. Pat. No. 7,441,597 to Kasevich discloses using a radio frequency generator to apply RF energy to a horizontal portion of an RF well positioned above a horizontal portion of an oil/gas producing well. The viscosity of the oil is reduced as a result of the RF energy, which causes the oil to drain due to gravity. The oil is recovered through the oil/gas producing well.

Unfortunately, long production times, for example, due to a failed start-up, to extract oil using SAGD may lead to significant heat loss to the adjacent soil, excessive consumption of steam, and a high cost for recovery. Significant water resources are also typically used to recover oil using SAGD, which impacts the environment. Limited water resources may also limit oil recovery. SAGD is also not an available process in permafrost regions, for example.

Moreover, despite the existence of systems that utilize RF energy to provide heating, such systems may suffer from inefficiencies as a result of impedance mismatches between the RF source, transmission line, and/or antenna. These mismatches become particularly acute with increased heating of the subterranean formation. Such system may also suffer from inefficiencies as a result of non-uniform RF energy heating patterns such that RF energy is directed into areas of the subterranean formation with reduced hydrocarbon resources.

SUMMARY OF THE INVENTION

In view of the foregoing background, it is therefore an object of the present invention to provide a hydrocarbon resource heating system that provides more efficient hydrocarbon resource heating.

This and other objects, features, and advantages in accordance with the present invention are provided by a system for heating hydrocarbon resources in a subterranean formation having a plurality of spaced-apart wellbores therein aligned in a plane. The system includes a plurality of radio frequency (RF) antennas configured to be positioned within respective ones of the plurality of spaced apart wellbores aligned in the plane. The system also includes a plurality of discrete RF sources each coupled to one of the plurality of RF antennas and configured so that the plurality of RF antennas are driven at a same frequency as each other RF antenna but at different phases. Accordingly, the hydrocarbon resource heating system may more efficiently heat the hydrocarbon resources by providing a more uniform heating pattern and with reduced interference.

Adjacent ones of the plurality of RF antennas are driven at respective different phases. Adjacent ones of the plurality of RF antennas may be driven at respective phases defining a phase difference in a range of 80 to 100 degrees, for example. The antennas may be driven at the same frequency defining a wavelength equal to between three and five times a spacing between adjacent ones of the plurality of RF antennas.

A method aspect is directed to a method of heating hydrocarbon resources in a subterranean formation having a plurality of spaced-apart wellbores therein aligned in a plane. The method includes positioning a plurality of radio frequency (RF) antennas within respective ones of the plurality of spaced apart wellbores aligned in the plane. The method also includes driving each of the plurality of RF antennas at a same frequency but at different phases.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate like elements in different embodiments.

Figure 1:
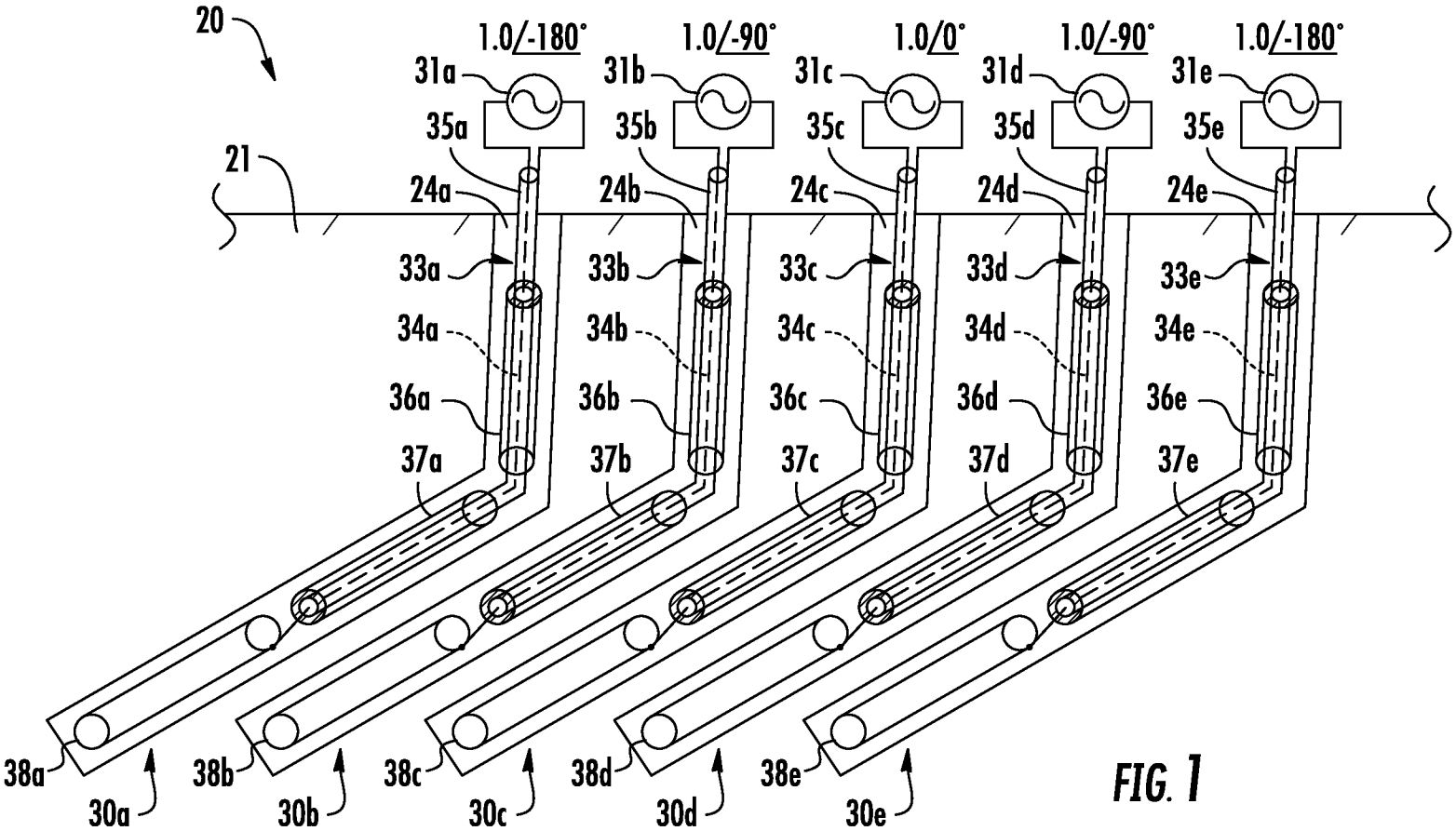
FIG. 1 is a schematic diagram of a system for heating hydrocarbon resources in accordance with the present invention.

Referring initially to FIG. 1, a system 20 for heating hydrocarbon resources in a subterranean formation 21 is described. The subterranean formation 21 includes spaced apart wellbore 24*a*-24*e* therein aligned in a plane. The spaced apart wellbores 24*a*-24*e* illustratively extend laterally within the subterranean formation 21. In some embodiments, the spaced apart wellbores 24*a*-24*e* may be a vertically extending wellbores, for example, and may extend vertically in the subterranean formation 21. Although not shown, in some embodiments a respective second or producing wellbore may be used below each of the wellbores 24*a*-24*e*, such as would be found in a SAGD implementation, for the collection of oil, etc., released from the subterranean formation 21 through heating.

Radio frequency (RF) antennas 30*a*-30*e* are positioned within respective ones of the plurality of spaced apart wellbores 24*a*-24*e* aligned in the plane. A respective RF source 31*a*-31*e* is coupled to each of the RF antennas 30*a*-30*e*.

A respective RF transmission line 33*a*-33*e* is coupled to each RF antenna 30*a*-30*e* and each RF source 31*a*-31*e*. Each RF transmission line 33*a*-33*e* is in the form of a coaxial RF transmission line and includes an inner conductor 34*a*-34*e* and an outer conductor 35*a*-35*e* surrounding the inner conductor.

Each RF antenna 30*a*-30*e* is in the form of an RF dipole antenna and is coupled to a distal end of the respective RF coaxial transmission line 33*a*-33*e*. Each of the RF dipole antennas 30*a*-30*e* includes a first electrically conductive sleeve 36*a*-36*e* that surrounds and is spaced apart from the RF coaxial transmission line 33*a*-33*e* defining a balun. A second electrically conductive sleeve 37*a*-37*e* surrounds and is spaced apart from the coaxial RF transmission line 33*a*-33*e*. The outer conductor 35*a*-35*e* of each RF coaxial transmission line 33*a*-33*e* is coupled to the second electrically conductive sleeve 37*a*-37*e* at a distal end of the RF coaxial transmission line defining a leg of the RF dipole antenna 30*a*-30*e*. A third electrically conductive sleeve 38*a*-38*e* is coupled to the inner conductor 34*a*-34*e* defining another leg of the RF dipole antenna 30*a*-30*e*. Of course, while an RF dipole antenna is described herein, it will be appreciated that other types of RF antennas may be used, and may be configured with the RF transmission line in other arrangements.

Each RF source 31*a*-31*e* is coupled to respective RF antennas 30*a*-30*e* and configured so that the RF antennas are driven at a same frequency but at different phases. More particularly, adjacent ones of the RF antennas 30*a*-30*e* are driven at respective different phases so that RF heating of the hydrocarbon resources is uniform between adjacent ones of the of RF antennas. For example, adjacent ones of the RF antennas 30*a*-30*e* may be driven at respective phases defining a phase difference in a range of 80 to 100 degrees, and more preferably at a phase difference of 90 degrees. As illustrated, for example, RF antennas 30*b*, 30*d* are driven at a 90-degree phase difference from RF antenna 30*c*, and RF antennas 30*a*, 30*e* are driven at a 180-degree phase difference from RF antenna 30*c*, and a 90-degree phase difference from RF antennas 30*b*, 30*d*.

Figure 2:
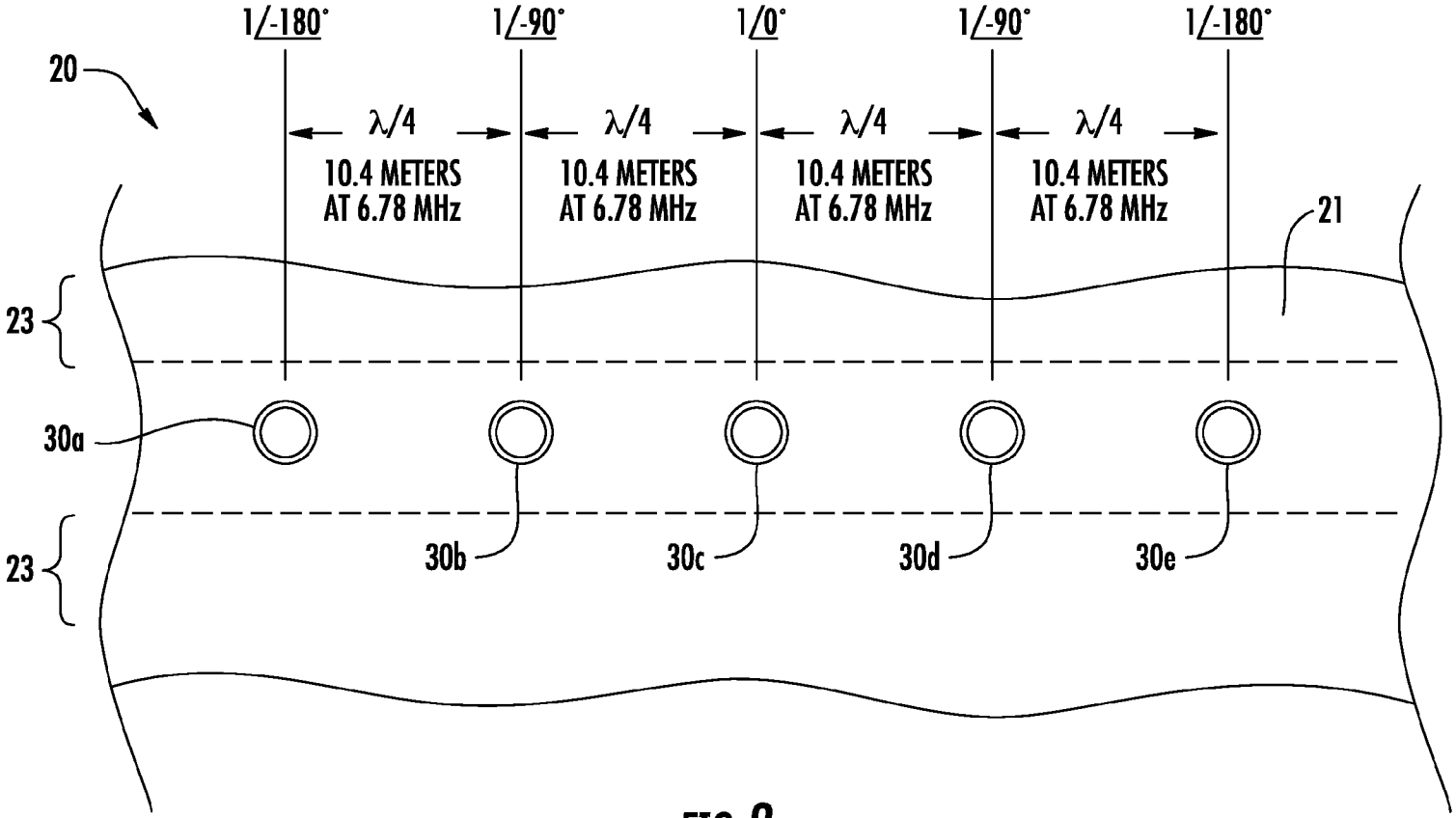
FIG. 2 is a schematic cross-sectional view of a portion of the system of FIG. 1.

Referring additionally to FIG. 2, the RF antennas 30*a*-30*e* are also driven at the same frequency defining a wavelength equal to three to five times a spacing between adjacent ones of the RF antennas, and more preferably, four times a spacing. In some embodiments, the RF antennas 30*a*-30*e* may be driven at the same frequency defining a wavelength up to 10 times a spacing between adjacent ones of the RF antennas. For example, a common wellbore or RF antenna spacing in a hydrocarbon resource field may be approximately 10.4 meters. Each RF antenna 30*a*-30*e* may be driven thus at about 6.78 MHz so that the wavelength between adjacent RF antennas is a quarter wavelength. Indeed, the phasing of each RF antennas 30*a*-30*e* is about equal to the propagation delay. By driving the RF antennas 30*a*-30*e* at a different phase to account for propagation delay, destructive interference patterns, such as, for example, standing wave patterns, may be reduced resulting in more efficient RF heating. The frequency and wavelength and phasing may be adjusted for different RF antenna spacing.

Additionally, to synthesize spaced apart RF antennas in a plane, it may be desirable to generate a radiation or heating pattern, for example, a two petal pattern, according to $\cos^n$. A $\cos^n$ heating pattern becomes increasingly planar as n increases, and most hydrocarbon formations are planar. So forming a RF heating antenna array underground reduces unwanted heating of overburden or bedrock. Driving the RF antennas 30*a*-30*e* at the same frequency and at different phases as noted above may more closely achieve a heating pattern that represents $\cos^n$, which may result in a more uniform radiation pattern (i.e., reducing radiation pattern nulls between adjacent RF antennas 30*a*-30*e* and reducing RF heating within the overburden regions 23) thus increasing efficiency. In contrast, a single horizontal dipole antenna, for example, may provide a less uniform or less horizontally planar heating pattern than antennas arranged in a plane.

A theory of operation of the system 20 includes bifurcating a traveling wave and matching the wave phase in the +/− Y-direction. Consider the following equation:

$$\phi_n=\beta l$$

where:

$\phi_n$=phase excitation at element n;

$\beta$=phase propagation constant; and l=length between elements in meters.

$\beta$=(radians/meter)(x wave slowing due to refraction) thus:

$$\beta=(2\pi/\lambda)(\in_r)$$

$$\lambda=(C/f)$$

where:

$\lambda$=wavelength in air in meters;

$\in_r$=relative permittivity of media (dimensionless);

C=speed of light (meters/second); and

F=frequency in Hertz.

Substituting:

$$\beta=(2\pi f\sqrt{(\in_r)})/C$$

$$\phi_n=\beta l=2\pi f l\sqrt{(\in_r)})/C$$

in radians for the phasing of the $n^{th}$ RF antenna. Indeed, this is the condition for traveling wave excitation at the $n^{th}$ RF antenna. Amplitude may be relatively uniform to make the heating also relatively uniform, e.g. divide the power equally among the RF antennas.

Figure 3:
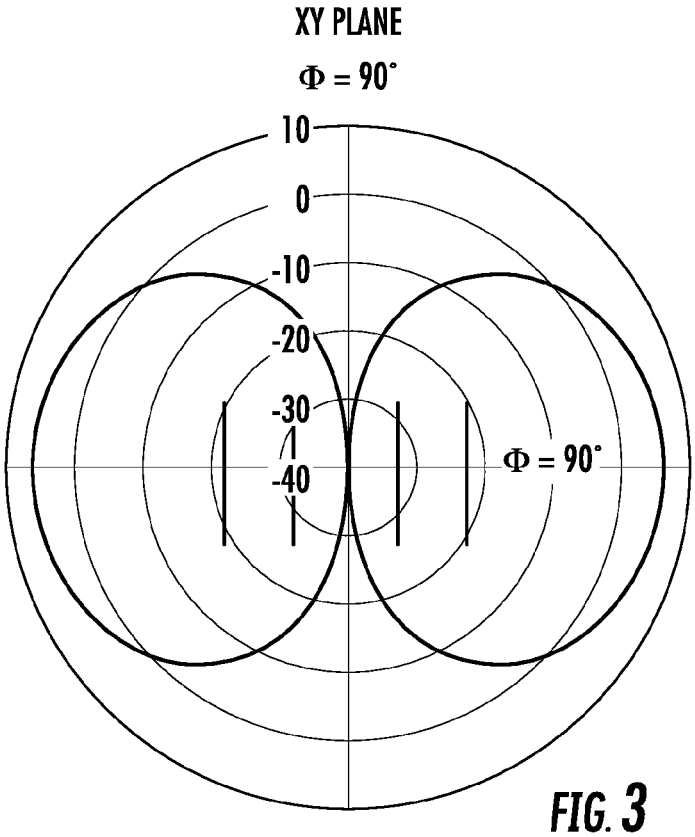
FIG. 3 is a graph of simulated gains in the XY plane for system of FIG. 1.
Figure 4:
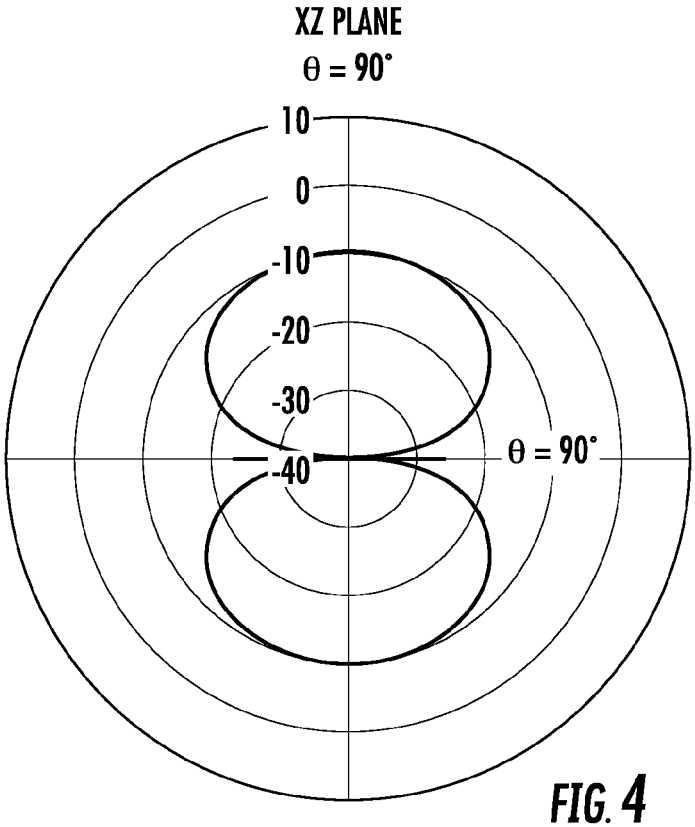
FIG. 4 is a graph of simulated gains in the XZ plane for system of FIG. 1.
Figure 5:
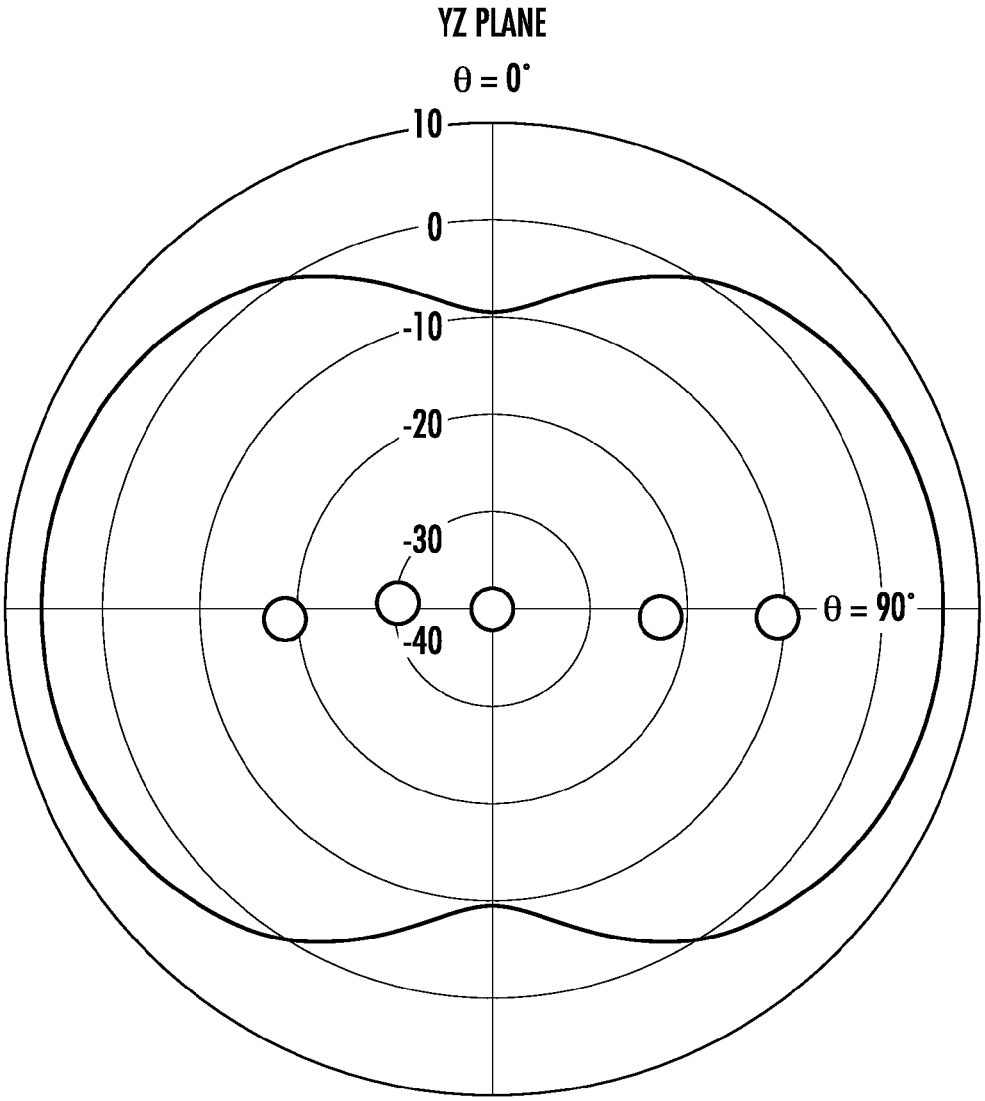
FIG. 5 is a graph of simulated gains in the YZ plane for system of FIG. 1.

Referring now to the graphs in FIGS. 3-5, respectively, the simulated gains for the system 20 in the XY plane, the XZ plane, and the YZ plane are illustrated. The gain or heating pattern in the YZ plane illustrated in FIG. 5 is that of 5-element array of RF heating dipoles, and is more uniform and may be considered relatively planar. The more dipoles are used the more planar the heating becomes.

A method aspect is directed to a method of heating hydrocarbon resources in a subterranean formation 21 having spaced apart wellbores 24*a*-24*e* therein aligned in a plane. The method includes positioning radio frequency (RF) antennas 30*a*-30*e* within respective ones of the spaced apart wellbores 24*a*-24*e* aligned in the plane. The method also includes driving each of the RF antennas 30*a*-30*e* at a same frequency but at different phases.

Figure 6:
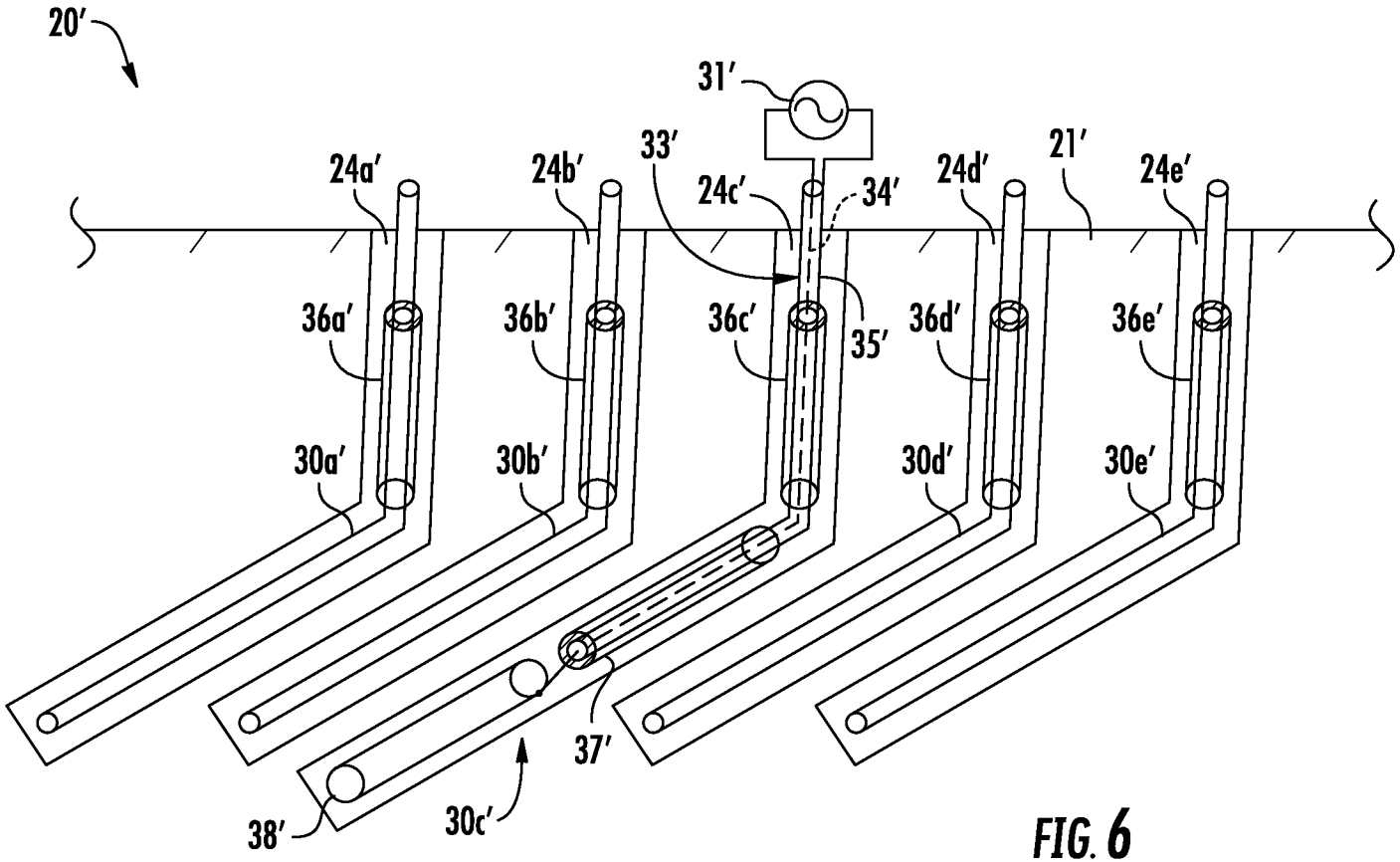
FIG. 6 is a schematic diagram of a subterranean formation including a system for heating hydrocarbon resources in accordance with another embodiment of the present invention.

Referring to FIG. 6, a system 20' for heating hydrocarbon resources in a subterranean formation 21' is described. The subterranean formation 21' includes spaced apart wellbores 24*a*'-24*e*' therein aligned in a plane. The spaced apart wellbores 24*a*'-24*e*' illustratively extend laterally within the subterranean formation 21'. In some embodiments, the spaced apart wellbores 24*a*'-24*e*' may be a vertically extending wellbores, for example, and may extend vertically in the subterranean formation 21'. Although not shown, in some embodiments a respective second or producing wellbore may be used below each of the wellbores 24*a*'-24*e*', such as would be found in a SAGD implementation, for the collection of oil, etc., released from the subterranean formation 21' through heating.

Radio frequency (RF) antennas 30*a*'-30*e*' are positioned within respective ones of the plurality of spaced apart wellbores 24*a*'-24*e*' aligned in the plane. An RF source 31' is coupled to one of the RF antennas 30*c*' to define a driven RF antenna. An RF transmission line 33' is coupled between the driven RF antenna 30*c*' and the RF source 31'. The RF transmission line 33' is in the form of a coaxial RF transmission line and includes an inner conductor 34' and an outer conductor 35' surrounding the inner conductor.

The driven RF antenna 30*c*' is in the form of an RF dipole antenna and is coupled to a distal end of the RF coaxial transmission line 33'. The driven RF dipole antenna 30*c*' includes a first electrically conductive sleeve 36*c*' that surrounds and is spaced apart from the RF coaxial transmission line 33*c*' defining a balun. A second electrically conductive sleeve 37' surrounds and is spaced apart from the coaxial RF transmission line 33'. The outer conductor 35' of the RF coaxial transmission line 33' is coupled to the second electrically conductive sleeve 37' at a distal end of the RF coaxial transmission line defining a leg of the driven RF dipole antenna 30*c*'. A third electrically conductive sleeve 38' is coupled to the inner conductor 34' defining another leg of the driven RF dipole antenna 30*c*'. Of course, while an RF dipole antenna is described herein, it will be appreciated that other types of RF antennas may be used, and may be configured with the RF transmission line in other arrangements.

The RF antennas 30*a*', 30*b*', 30*d*', 30*e*' that are adjacent the driven RF antenna 30*c*' define passive RF antennas. Each of the passive RF antennas 30*a*', 30*b*', 30*d*', 30*e*' may be an electrically conductive well pipe, for example. The driven RF antenna 30*c*' and the passive RF antennas 30*a*', 30*b*', 30*d*', 30*e*' are configured so that the RF antennas 30*a*'-30*e*' operate at a same frequency but at a different phase. While four passive RF antennas 30*a*', 30*b*', 30*d*', 30*e*' are illustrated, any number of passive RF antennas may be used.

More particularly, the driven RF antenna 30*c*' is driven so that adjacent ones of the RF antennas 30*a*', 30*b*', 30*d*', 30*e*' operate at respective different phases and so that RF heating of the hydrocarbon resources is uniform between adjacent ones of the of RF antennas. For example, the driven RF antenna 30*c*' is driven so that adjacent ones of the RF antennas 30*a*'-30*e*' may operate at respective phases defining a phase difference in a range of 80 to 100 degrees, and more preferably at a phase difference of 90 degrees.

The driven RF antenna 30*c*' is also driven so that the RF antennas 30*a*'-30*e*' operate at the same frequency defining a wavelength equal to three to five times a spacing between adjacent ones of the RF antennas, and more preferably, four times a spacing. In some embodiments, the driven RF antenna 30*c*' may be driven so that the RF antennas 30*a*'-30*e*' operate at the same frequency defining a wavelength up to 10 times a spacing between adjacent ones of the RF antennas. For example, a common wellbore or RF antenna spacing in a hydrocarbon resource field may be approximately 10.4 meters. The driven RF antenna 30*c*' may be driven so that the RF antennas 30*a*'-30*e* operate at about 6.78 MHz and so that the wavelength between adjacent RF antennas is a quarter wavelength.

The spacing between adjacent ones of the RF antennas 30*a*'-30*e*' may also be closer together or get smaller closer to the RF driven antenna 30*c*'. In other words, the spacing between the driven RF antenna 30*c*' and the passive RF antenna 30*b*' is smaller than the spacing between the passive RF antenna 30*b*' and the passive RF antenna 30*a*'.

Indeed, the phasing of each RF antenna 30*a*'-30*e*' is about equal to the propagation delay. By driving the driven RF antenna 30*c*' so that the RF antennas 30*a*'-30*e*' operate at a different phase to account for propagation delay, destructive interference may be reduced resulting in more efficient RF heating. The frequency and wavelength may be adjusted for different RF antenna spacing.

Additionally, to synthesize spaced apart RF antennas in a plane, it may be desirable to generate a radiation or heating pattern according to $\cos^n$. A $\cos^n$ heating pattern may be considered approximately planar. Driving the driven RF antenna 30*c*' so that the RF antennas 30*a*'-30*e*' operate at the same frequency and at different phases as noted above may more closely achieve a heating pattern that represents $\cos^n$ which may result in a more uniform radiation pattern (i.e., reducing radiation pattern nulls between adjacent RF antennas and reducing RF heating within the overburden regions) thus increasing efficiency. In contrast, a single horizontal dipole antenna, for example, may provide a less uniform or less horizontally planar heating pattern than antennas arranged in a plane.

Since the passive RF antennas 30*a*', 30*b*', 30*d*', 30*e*' are not driven by a respective RF source and operate paristically, the passive RF antennas may be configured to operate at the same frequency but at different phases. More particularly, the length of each of passive RF antennas 30*a*', 30*b*', 30*d*', 30*e*' is adjusted for the corresponding phase, for example, so that adjacent ones of the RF antennas 30*a*'-30*e*' operate at respective phases defining a phase difference in a range of 80 to 100 degrees, and more preferably at a phase difference of 90 degrees, as described above. A shorter passive RF antenna 30*a*', 30*b*', 30*d*', 30*e*' operates above resonance and thus have a leading phase with respect to the driven RF antenna 30*c*', while a longer passive RF antenna operates below resonance and lags in phase with respect to the driven RF antenna. The driven RF antenna 30*c*' has a length at its natural resonance.

An electrically conductive sleeve 36*a*', 36*b*', 36*d*', 36*e*' defining a balun surrounds and is spaced apart from the each of the passive RF antennas 30*a*', 30*b*', 30*d*', 30*e*'. The location of each of the electrically conductive sleeves 36*a*', 36*b*', 36*d*', 3' relative to respective passive RF antennas 30*a*', 30*b*', 30*d*', 30*e*' adjusts the electrical length thereof. As noted above, the physical lengths of the passive RF antennas 30*a*', 30*b*', 30*d*', 30*e*' are adjusted to adjust respective phases.

During operation, the parasitic or passive RF antennas 30*a*', 30*b*', 30*d*', 30*e*' inductively couple to the driven RF antenna 30*c*'. Thus, the near fields of the RF antennas 30*a*'-30*e*' overlap each other inducing electric currents on the RF antennas. A traveling electromagnetic (EM) wave develops along the RF antennas 30*a*'-30*e*' as the current radiate and the fields combine. The radiation or heating pattern is similar to that where all the RF antennas 30*a*'-30*e*' are driven by a respective RF source: $\cos^n$. The length of each of the passive RF antennas 30*a*', 30*b*', 30*d*', 30*e*' is slightly shorter than the driven RF antenna 30*c*' causing the current phase to lead. This is because the EM wave increases in speeds as it gets further away from the driven RF antenna 30*c*', and it thus desirable to have the current add in phase when the EM wave arrives at a given passive RF antenna 30*a*', 30*b*', 30*d*', 30*e*'.

As noted above, the spacing between adjacent ones of the RF antennas 30*a*'-30*e*' may also be smaller the closer to the RF driven antenna 30*c*'. This is because the EM wave is slower near the driven RF antenna 30*c*'. In some instances, heating may be accomplished without formation of an EM wave, although an EM wave generally forms as dessication occurs. Initially the system 20' operates as a near field heating system and then a far field radiated wave heating system as the subterranean formation 21' changes.

A method aspect is directed to a method for heating hydrocarbon resources in a subterranean formation 21' having spaced-apart wellbores 24*a*'-24*e*' therein aligned in a plane. The method includes positioning radio frequency (RF) antennas 30*a*'-30*e*' within respective ones of the plurality of spaced apart wellbores 24*a*'-24*e*' aligned in the plane. The method also includes driving one the plurality of RF antennas 30*c*' to define a driven RF antenna with adjacent ones of the RF antennas 30*a*', 30*b*', 30*d*', 30*e*' defining passive RF antennas so that the RF antennas operate at a same frequency but at different phases.

Another method aspect is directed to empirically determining an optimum phase of the RF power to be applied to each of the RF antennas 30*a*-30*e*. The method may include, except for the center RF antenna, terminating all the RF antenna elements at the surface with resistive loads, such as a 50 Ohm load or conjugate match resistive loads, for example. The method further includes exciting the center element with RF power, such as for example, a sinusoidal waveform excitation at the center element resonant frequency, and measuring the phase of the RF voltage developed across the resistively terminated RF antennas 30*a*-30*e*, relative to that of the center element. The method further includes adjusting the excitation phase of each of RF sources 31*a*-31*e* to be to the same, or substantially similar to the measured phase. The RF sources 31*a*-31*e* are connected to the RF antennas 30*a*-30*e* and heat the subterranean formation 21. The above noted steps of terminating, exciting, measuring, and adjusting may be periodically repeated to maintain the optimum excitation phase.

Initially, it is understood that each RF antennas 30*a*-30*e* may be electrically isolated and shielded from each other, as the subterranean formation 21 may include substantial quantities of liquid water: a Faraday Cage in situ. The liquid water content diminishes over time however due to extraction and conversion to steam, which may depend on pumping and heating rates, for example. Thus, the electromagnetic fields from each of the RF antennas 30*a*-30*e* increasingly overlap with time such that the teachings described herein increasingly apply over time, as the heating and extraction progress.

As the heating front advances, the connate water in the subterranean formation 21 may be converted to steam, or partially to steam. This reduces the relative permittivity of the subterranean formation 21 such that the phase propagation constant (degrees of phase per meter of distance) in the subterranean formation may change. In particular, the phase shift of excitation between elements may become less over time. The empirical method described above may advantageously manage this.

Each RF antenna 30*a*-30*e* may initially heat the subterranean formation 21 by a combination of 1) induction by reactive electric near fields, 2) induction by reactive magnetic near fields, and 3) conduction of electric currents from bare antenna surfaces (if any). Later, as liquid water in the subterranean formation 21 is diminished due to conversion to steam and or by extraction, radiation of far field radio waves from each RF antenna 30*a*-30*e* increasingly occur. This may be transparent and unnoticed by system operators, but is an advantageous feature that allows penetration of heating energy to great distances from the RF antennas 30*a*-30*e*.

Each RF antenna 30*a*-30*e* is capable of supplying up to 8 terms of near, middle, and far field electromagnetic energies, E, H and I. The passage of RF magnetic fields through conductive hydrocarbon formations causes eddy electric currents to flow in the subterranean formation 21 through the magnetic coupling form of induction and Amperes Law, and the eddy electric currents then heat resistively by joule effect. The passage of RF electric fields through conductive hydrocarbon formations also causes electrical currents to flow, by the capacitive coupling form of induction, and these coupled electric currents heat resistively by joule effect. In a greatly simplified sense, the dipole arms of the RF antenna 30*a*-30*e* are capacitor plates, transformer winding primaries, and radiating antennas at the same time. Bare antenna elements may initially also include electrodes. Dielectric heating by electric fields can occur at higher radio frequencies, but may be secondary to joule effect at lower frequencies. Thus many mechanisms may serve to provide reliable heating as subterranean formation characteristics change over time.

As an example, a typical rich Athabasca oil sand at 1 MHz may have a bitumen content of 15%, a water content of 1% and at 1 MHz an electrical conductivity of 0.005 mhos/meter, and a relative permittivity of 11. It is a radio frequency heating susceptor over a wide frequency range. The electrical conductivity of rich Athabasca oil sand varies according to hydrocarbon content, the leaner ores being more electrically conductive. There is not a fundamental limit on the frequency ranges that may be used for RF heating hydrocarbon formations, but it is desirable to obtain sufficient load resistance, which may be met by a sufficiently high frequency, and a desire for penetration and useful antenna size that may be met by using a sufficiently low frequency. In oil sands about 1 KHz to 10 MHz may be preferred. In particular, it may be useful to operate dipole antennas at first, half wave resonance, and for a 1 kilometer long horizontal directional drilling (HDD) system dipole in oil sand, the insulated half wave dipole resonance is about 150 KHz. Radiation resistances in the tens of ohms have been analyzed for this. While a particular theory or theories of operation has been described, other theories may be also be applicable to the embodiments described herein.

A prototype using a single RF antenna was tested in a bench of high grade Athabasca oil sand. Only a single RF dipole antenna was used, but in a build-out, many dipoles are envisioned. The electrically active portion of the single subterranean dipole was 70 feet long and operated at half wave resonance at 6.78 MHz with a RF power level varying between 20 to 100 kilowatts, supplied by Eimac 4CX100,000 tetrode vacuum tubes in a push-pull mode. Electrical load impedance varied during heating, but was under 3 to 1 in a 50 Ohm system throughout. The dipole was insulated from the formation in a dielectric conduit, although boil off methods for uninsulated RF antennas have also been exhibited. The transmission line was Electronics Industries Association rigid coax or "hard line". Heating penetration was relatively rapid and an elongate, football shaped heated area quickly developed. A steam saturation zone was allowed to form by continuing the rapid heating rate for several weeks. RF heating mobilized the oil from the tar sand, and it moved radially inward toward the RF antenna.

About 600 gallons of high quality oil filled the oversize hole the RF antenna was in. The produced oil was thinned relative Clark process bitumen and paraffinic in nature. A saturates aromatics resins and asphaultines (SARA) analysis of the produced oil revealed 20% saturates, 41% aromatics, 8% polar 1, and 31% polar 2 so upgrading was evident. Gravimetric pentane (C5) was 15, gravimetric heptanes (C7) was 1.3, so asphalt content was lower relative Clark process bitumen. Measured viscosity in centipoids was about 38,550 at 20° C., 1796 at 50° C., 237 at 80° C., and 7.6 at 180° C., so the RF heating produced oil that was thinned. RF heating using a ½ wave dipole was generally reliable in operation. Thus, by using a plurality of RF antennas allows the RF heating to be planarized for horizontal strata and hydrocarbon payzones, for increased penetration, speed, and efficiency, for example.

Many modifications and other embodiments of the invention will also come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A system for heating hydrocarbon resources in a subterranean formation having a plurality of spaced-apart wellbores therein aligned in a plane, the system comprising:

a plurality of radio frequency (RF) antennas to be positioned within respective ones of the plurality of spaced apart wellbores aligned in the plane; and an RF source coupled to one said plurality of RF antennas defining a driven RF antenna with adjacent ones of said plurality of RF antennas each having a different length defining passive RF antennas and being configured so that said plurality of RF antennas operate at a same frequency but at different phases based upon each different length.

2. The system of claim 1, wherein said driven RF antenna is driven so that adjacent ones of said plurality of RF antennas are operating at respective different phases and so that RF heating of the hydrocarbon resources is uniform between adjacent ones of said plurality of RF antennas.

3. The system of claim 1, wherein said driven RF antenna is driven so that adjacent ones of said plurality of RF antennas are operating at respective phases defining a phase difference in a range of 80 to 100 degrees.

4. The system of claim 1, wherein said driven RF antenna is driven so that said plurality of RF antennas are operating at the same frequency defining a wavelength equal to three to five times a spacing between adjacent ones of said plurality of RF antennas.

5. The system of claim 1, further comprising a transmission line coupled between said RF source and said driven RF antenna.

6. The system of claim 1, further comprising a respective balun coupled to each of said plurality of RF antennas.

7. A method for heating hydrocarbon resources in a subterranean formation having a plurality of spaced-apart wellbores therein aligned in a plane, the method comprising:

positioning a plurality of radio frequency (RF) antennas within respective ones of the plurality of spaced apart wellbores aligned in the plane; and driving one of the plurality of RF antennas to define a driven RF antenna with adjacent ones of the plurality of RF antennas each having a different length defining passive RF antennas so that the plurality of RF antennas operate at a same frequency but at different phases based upon each different length.

8. The method of claim 7, wherein driving comprises driving the driven RF antenna so that adjacent ones of the plurality of RF antennas operate at respective different phases and so that RF heating of the hydrocarbon resources is uniform between adjacent ones of the plurality of RF antennas.

9. The method of claim 7, wherein driving comprises driving the driven RF antenna so that adjacent ones of the plurality of RF antennas operate at respective phases defining a phase difference in a range of 80 to 100 degrees.

10. The method of claim 7, wherein driving comprises driving the driven RF antenna so that the plurality of RF antennas operate at the same frequency defining a wavelength equal to three to five times a spacing between adjacent ones of the plurality of RF antennas.

11. The method of claim 7, further comprising coupling a transmission line to the driven RF antenna.

12. The method of claim 7, further comprising coupling a respective balun to each of the plurality of RF antennas.

13. A system for heating hydrocarbon resources in a subterranean formation having a plurality of spaced-apart wellbores therein aligned in a plane, the system comprising:

a plurality of radio frequency (RF) antennas to be positioned within respective ones of the plurality of spaced apart wellbores aligned in the plane;

an RF source coupled to one said plurality of RF antennas defining a driven RF antenna with adjacent ones of said plurality of RF antennas each having a different length defining passive RF antennas and being configured so that said plurality of RF antennas operate at a same frequency, so that adjacent ones of said plurality of RF antennas operate at respective different phases based upon each different length, and so that RF heating of the hydrocarbon resources is uniform between adjacent ones of said plurality of RF antennas; and a transmission line coupled between said RF source and said driven RF antenna.

14. The system of claim 13, wherein said driven RF antenna is driven so that adjacent ones of said plurality of RF antennas are operating at respective phases defining a phase difference in a range of 80 to 100 degrees.

15. The system of claim 13, wherein said driven RF antenna is driven so that said plurality of RF antennas are operating at the same frequency defining a wavelength equal to three to five times a spacing between adjacent ones of said plurality of RF antennas.

16. The system of claim 13, further comprising a respective balun coupled to each of said plurality of RF antennas.

* * * * *